US007772539B2

(12) United States Patent
Kumar

(10) Patent No.: US 7,772,539 B2
(45) Date of Patent: Aug. 10, 2010

(54) SYSTEM AND METHOD FOR DETERMINING CHARACTERISTIC INFORMATION OF AN OBJECT POSITIONED ADJACENT TO A ROUTE

(75) Inventor: Ajith Kuttannair Kumar, Erie, PA (US)

(73) Assignee: General Electric Company, Schenectady, NY (US)

( * ) Notice: Subject to any disclaimer, the term of this patent is extended or adjusted under 35 U.S.C. 154(b) by 6 days.

(21) Appl. No.: 12/249,449

(22) Filed: Oct. 10, 2008

(65) Prior Publication Data

US 2010/0090135 A1 Apr. 15, 2010

(51) Int. Cl.
*G07B 15/02* (2006.01)

(52) U.S. Cl. ..... 250/221; 250/208.1; 250/370.08; 382/104

(58) Field of Classification Search ..... 250/208.1, 250/221, 370.08
See application file for complete search history.

(56) References Cited

U.S. PATENT DOCUMENTS 5,627,508 A 5/1997 Cooper et al.
6,088,635 A 7/2000 Cox et al.
6,141,611 A 10/2000 Mackey
6,630,884 B1 10/2003 Shanmugham
6,714,738 B2 3/2004 Kato et al.
6,829,430 B1 12/2004 Ashizaki et al.
6,954,224 B1 10/2005 Okada et al.
7,127,348 B2 10/2006 Smitherman et al.
7,199,366 B2 * 4/2007 Hahn et al. ..... 250/330

FOREIGN PATENT DOCUMENTS

JP 2008009941 * 1/2008

* cited by examiner

*Primary Examiner*—Georgia Y Epps
*Assistant Examiner*—Tony Ko
(74) *Attorney, Agent, or Firm*—Robert Wawrzyn, Esq.; Terry M. Sanks, Esq.; Beusse Wolter Sanks Mora & Maire, P.A.

(57) ABSTRACT

A system is provided for determining characteristic information of an object positioned adjacent to a route. The system includes a first camera configured to collect a first set of spectral data of the object. The system further includes a second camera configured to collect a second set of spectral data of the object. The first and second cameras are attached to a powered system traveling along the route. The system further includes a controller coupled to the first camera and the second camera. The controller is configured to determine the characteristic information of the object based on the first set of spectral data and the second set of spectral data of the object. Additionally, a method is provided for determining characteristic information of the object positioned adjust to the route.

13 Claims, 10 Drawing Sheets

SYSTEM AND METHOD FOR DETERMINING CHARACTERISTIC INFORMATION OF AN OBJECT POSITIONED ADJACENT TO A ROUTE

BACKGROUND OF THE INVENTION

In conventional locomotive imaging systems, cameras collect video information of the locomotive or surrounding railroad system, which is then typically stored in a memory of a processor. For example, such collected video information may include a railroad signal image collected from a railroad signal positioned adjacent to a railroad track. The processor may attempt to determine the color of the railroad signal, for purposes of controlling the operation of the locomotive, such as determining whether to continue along a portion of the railroad track, for example.

These conventional locomotive imaging systems may have complex recognition software and/or hardware to determine whether a collected image of a railroad signal is a particular color, for example. However, these conventional imaging systems have several drawbacks, such as in determining the color of railroad signals painted with a color coating. These conventional imaging systems may determine the color of such railroad signals based on the color coating, and thus the determination may not be indicative of whether the railroad signal is in an active status (e.g., on or off, blinking), which in-turn minimizes the significance of the determined color. Thus, there is a need for an imaging system which determines a color of the railroad signal, but also verifies that the railroad signal is in an active status.

BRIEF DESCRIPTION OF THE INVENTION

One embodiment of the present invention provides a system for determining characteristic information of an object positioned adjacent to a route. The system includes a first camera configured to collect a first set of spectral data of the object. The system further includes a second camera configured to collect a second set of spectral data of the object. The first and second cameras are attached to a powered system traveling along the route. The system further includes a controller coupled to the first camera and the second camera. The controller is configured to determine the characteristic information of the object based on the first set of spectral data and the second set of spectral data of the object.

Another embodiment of the present invention provides a system for determining characteristic information of an object positioned adjacent to a route. The system includes a thermal camera configured to collect non-visible spectral data of the object. The system further includes a video camera configured to collect visible spectral data of the object. The thermal camera and the video camera are attached to a powered system traveling along the route. The characteristic information of the object is determined based on the non-visible spectral data and the visible spectral data of the object.

Another embodiment of the present invention provides a method for determining characteristic information of the object positioned adjacent to the route. The method includes collecting a first set of spectral data of the object and collecting a second set of spectral data of the object. The method further includes determining the characteristic information of the object based on the first set of spectral data and the second set of spectral data of the object.

BRIEF DESCRIPTION OF THE DRAWINGS

A more particular description of the embodiments of the invention briefly described above will be rendered by reference to specific embodiments thereof that are illustrated in the appended drawings. Understanding that these drawings depict only typical embodiments of the invention and are not therefore to be considered to be limiting of its scope, the embodiments of the invention will be described and explained with additional specificity and detail through the use of the accompanying drawings in which.

DETAILED DESCRIPTION OF THE INVENTION

In describing particular features of different embodiments of the present invention, number references will be utilized in relation to the figures accompanying the specification. Similar or identical number references in different figures may be utilized to indicate similar or identical components among different embodiments of the present invention.

Though exemplary embodiments of the present invention are described with respect to rail vehicles, or railway transportation systems, specifically trains and locomotives having diesel engines, exemplary embodiments of the invention are also applicable for other uses, such as but not limited to off-highway vehicles (OHV), marine vessels, agricultural vehicles, and transport buses, each which may use at least one diesel engine, or diesel internal combustion engine. Towards this end, when discussing a specified mission, this includes a task or requirement to be performed by the diesel powered system. Therefore, with respect to railway, marine, transport vehicles, agricultural vehicles, or off-highway vehicle applications this may refer to the movement of the system from a present location to a destination. Likewise, operating conditions of the diesel-fueled power generating unit may include one or more of speed, load, fueling value, timing, etc. Furthermore, although diesel powered systems are disclosed, those skilled in the art will readily recognize that embodiments of the invention may also be utilized with non-diesel powered systems, such as but not limited to natural gas powered systems, bio-diesel powered systems, etc. Furthermore, as disclosed herein such non-diesel powered systems, as well as diesel powered systems, may include multiple engines, other power sources, and/or additional power sources, such as, but not limited to, battery sources, voltage sources (such as but not limited to capacitors), chemical sources, pressure based sources (such as but not limited to spring and/or hydraulic expansion), current sources (such as but not limited to inductors), inertial sources (such as but not limited to flywheel devices), gravitational-based power sources, and/or thermal-based power sources.

Figure 1:
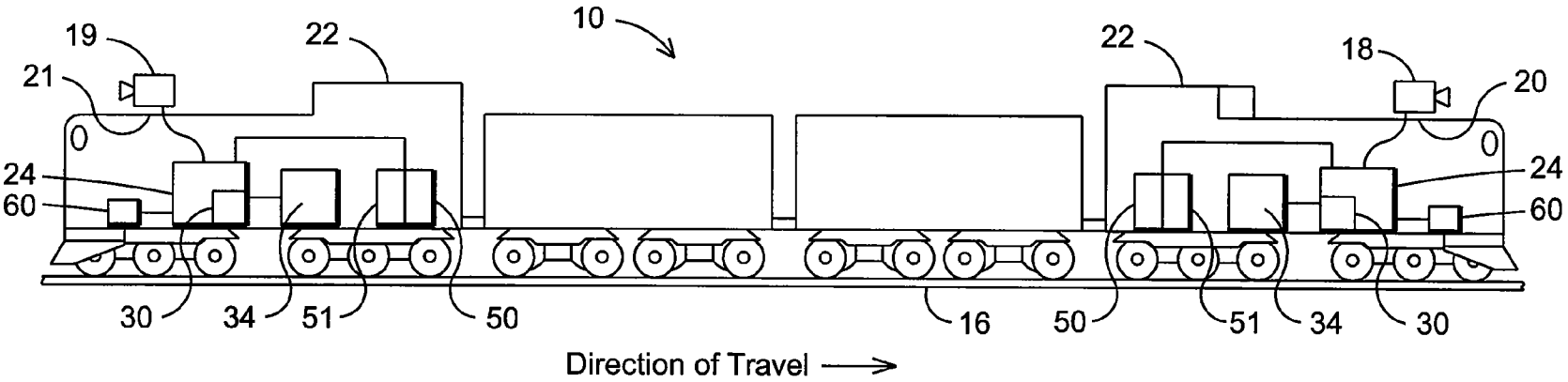
FIG. 1 is a side view of a locomotive within a system for processing images of wayside equipment, according to an exemplary embodiment of the present invention.
Figure 2:
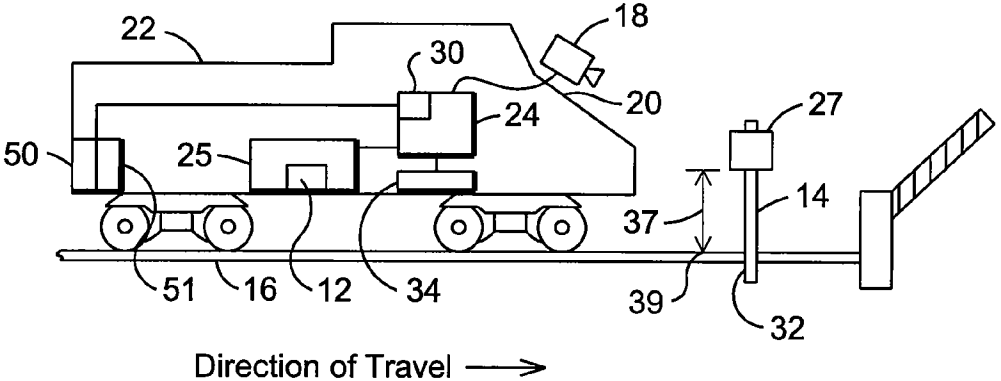
FIG. 2 is a side view of an exemplary embodiment of a locomotive within the system for processing images of wayside equipment illustrated in FIG. 1.

FIGS. 1-2 illustrate an embodiment of a system 10 for processing images 12 of wayside equipment 14 adjacent to a railroad 16. The system 10 includes a controller 24 within a locomotive 22. FIG. 1 illustrates a distributive power arrangement, in which two locomotives 22 are separated by a plurality of train cars, while FIG. 2 illustrates a single locomotive arrangement. The embodiments of the present invention discussed herein are not limited to either of the arrangements illustrated in FIGS. 1 and 2. A plurality of video cameras, such as a forward looking camera 18 and a rearward looking camera 19 are positioned on a respective front and rear external surface 20,21 of the locomotive 22. Although FIGS. 1-2 illustrate the cameras 18,19 being positioned on a respective external surface 20,21 of the locomotive 22, the cameras need not be positioned on an external surface of the locomotive, but instead may merely be attached to any portion of the locomotive 22, such as within a inner recess, for example. Each video camera 18,19 is configured to collect visible spectral data of the wayside equipment 14 as the locomotive 22 travels along the railroad 16. The controller 24 is coupled to the video camera 18 (FIG. 2), or alternatively, a respective controller 24 may be coupled to each video camera 18,19 (FIG. 1), to process the visible spectral data. Additionally, the controller 24 is configured to transmit a signal to a locomotive engine 50 based upon processing the visible spectral data, and this signal may be used to change the operating mode of the locomotive 22, as described below.

Figure 4:
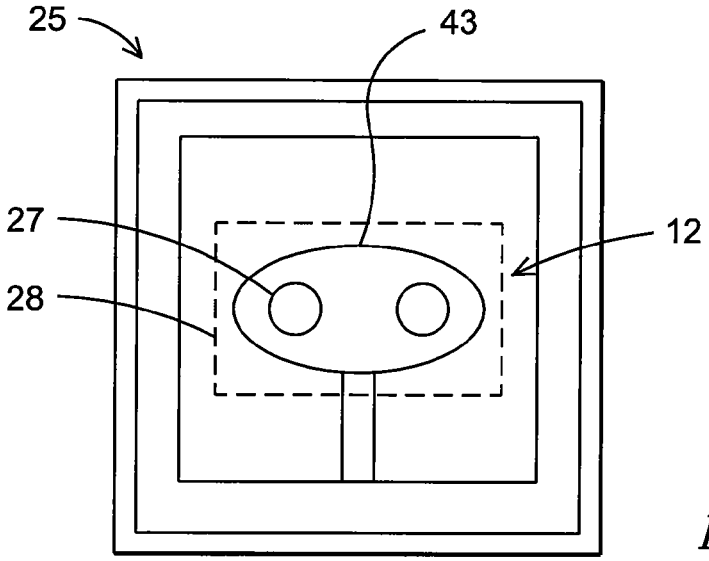
FIG. 4 is a plan view of a display from the system for processing images of wayside equipment illustrated in FIG. 1.

As illustrated in FIG. 2, the wayside equipment 14, whose spectral data is collected and processed by the video cameras 18,19 and controller 24, may be a light signal or a track number indicator for the locomotive 22, for example. For marine applications, the wayside equipment 14 may be a buoy, for example. For OHV, transport buses, and agricultural vehicles, the wayside equipment 14 may be a signal such as a light signal or a signal indicating a parameter of the route, for example. As illustrated in FIG. 4, a display 25 (FIG. 2) shows the images 12 of the wayside equipment 14 subsequent to the collection of spectral data from the wayside equipment 14 by the video cameras 18,19. Each video camera 18,19 may be configured to process pixels within an adjustable field of view 28 (see FIG. 4), where the adjustable field of view of the video camera is adjusted to coincide with some or all of the wayside equipment 14. For example, in the exemplary embodiment of FIG. 4, the adjustable field of view 28 of the video cameras 18,19 is adjusted such that the light signal portion 27 (FIG. 2) of the wayside equipment 14 is visible on the display 25.

Additionally, as illustrated in FIGS. 1-2, the controller 24 includes a memory 30 configured to store one or more expected positions 32 of the wayside equipment 14 along the railroad 16. For example, the memory 30 may store one or more distances for a particular track number from a fixed position, and thus the locomotive operator may retrieve these stored distances to determine the positions of the wayside equipment 14. Additionally, the memory 30 may store one or more position coordinates of the wayside equipment 14, and the system 10 may include a position determination device, such as a GPS (global positioning system) device, for example, coupled to the controller 24 to determine a position of the locomotive 22 along the railroad 16. (The GPS device may be one of several communications equipment components 34 carried on board the locomotive 22, for wireless communications or otherwise, including for example ISCS (International Satellite Communications System), satellite, cellular, and WLAN (wide local area network) components.) The controller 24 is configured to compare the stored position coordinates of the wayside equipment 14 with the present position of the locomotive 22 based on the GPS device or other position determination device. Once the locomotive 22 reaches the expected position 32 (or upon approaching the expected position 32) of the wayside equipment, the controller 24 arranges for the video cameras 18,19 to collect the visible spectral data of the wayside equipment 14. In collecting the visible spectral data of the wayside equipment 14, the field of view 28 (FIG. 4) of the video cameras 18,19 are adjusted to collect the visible spectral data of the wayside equipment 14 positioned at the expected position 32.

Figure 3:
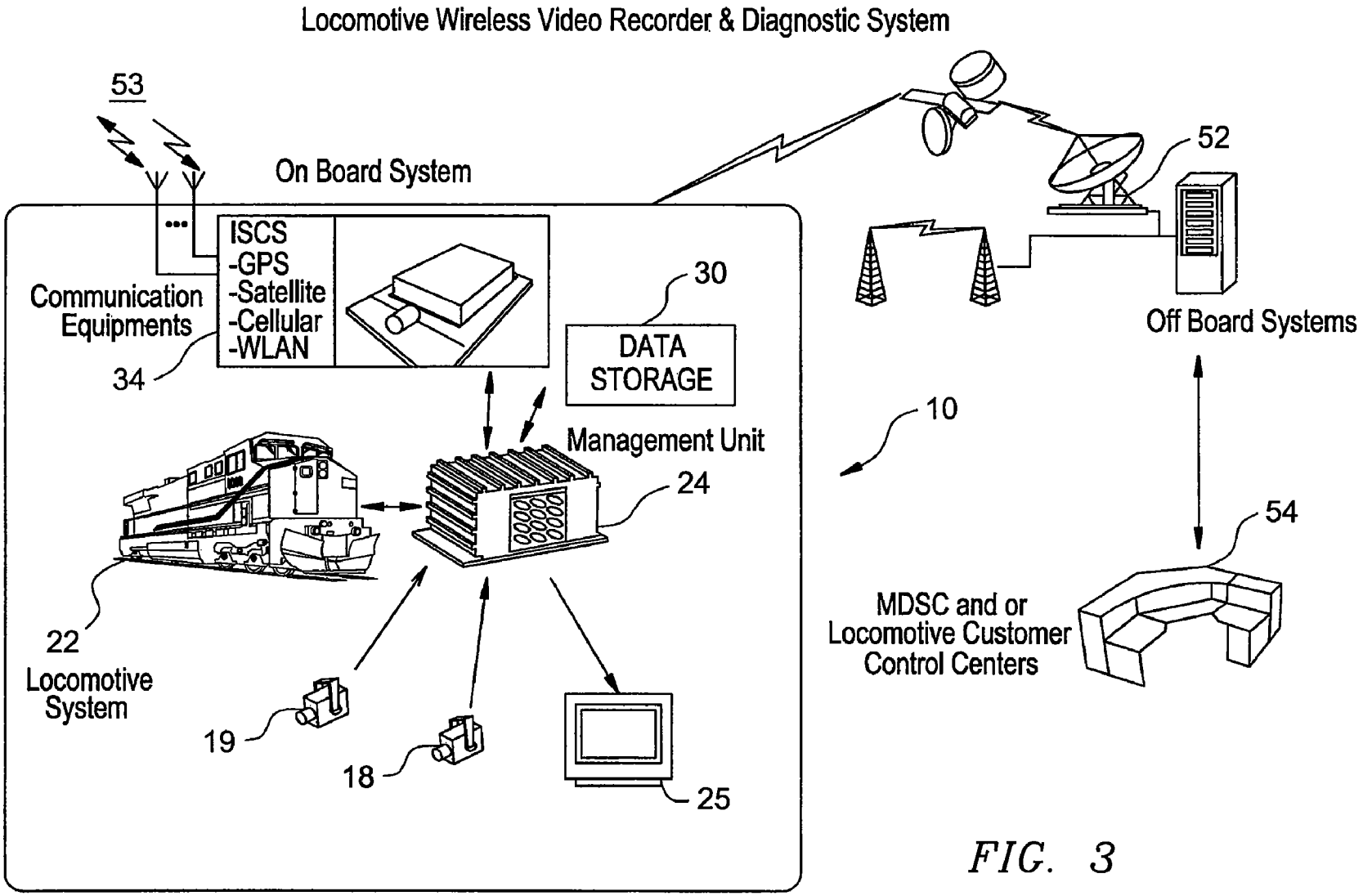
FIG. 3 is a schematic view of an exemplary embodiment of a system for processing images of wayside equipment according to the present invention.

FIG. 3 illustrates an exemplary embodiment of a system 10 and the communications between the (on-board) system 10 and external devices, such as a satellite receiver 52 and/or a command center 54, for example. (As indicated in FIG. 3, the command center 54 may be, for example, a locomotive customer control center or a MDSC (Monitoring and Diagnostics Service Center). The satellite receiver 52 may provide position information of the locomotive 22 to a transceiver 53 on the locomotive 22, which is then communicated to the controller 24. The progress of the locomotive 22, in terms of properly processing spectral data of each wayside equipment 14 at each expected position 32 may be externally monitored (automatically or manually by staff) by the command center 54.

Figure 5:
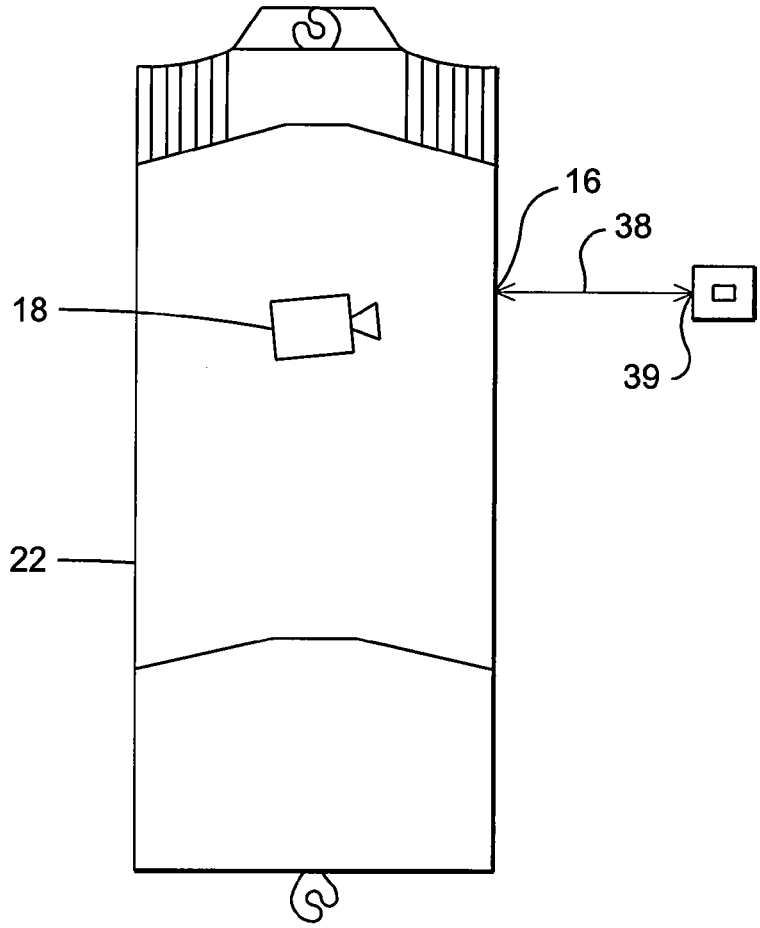
FIG. 5 is a top view of an exemplary embodiment of a locomotive within the system for processing images of wayside equipment illustrated in FIG. 1.

In an exemplary embodiment of the present invention, the memory or other data storage 30 may further store one or more position parameters of the wayside equipment 14 at each expected position 32. The field of view 28 is adjusted based upon the one or more stored position parameters to collect the visible spectral data of the wayside equipment 14 positioned at the expected position 32. As illustrated in FIG. 2, once the locomotive 22 reaches an expected position 32 of the wayside equipment 14, the controller 24 is configured to align the video cameras 18,19 with the wayside equipment 14 based upon on the position parameters. Examples of such position parameters include a perpendicular distance 37 from a ground portion 39 to the light signal portion 27 of the wayside equipment 14 (FIG. 2), and a perpendicular distance 38 from a portion of the railroad 16 to the ground portion 39 (FIG. 5).

When the wayside equipment 14 is a light signal, the memory 30 is configured to store an expected color of the light signal positioned at the expected position 32. Additionally, the memory 30 is configured to store an expected profile of the light signal frame 43 at the expected position 32 and is further configured to store an expected position of the wayside equipment 14, such as the light signal having the expected color along the light signal frame 43 (FIG. 4). For example, as illustrated in FIG. 4, the memory 30 may store information indicating that the light signal portion 27 of the wayside equipment 14, such as the light signal along the light signal frame 43, is a pair of centered light signals along the light signal frame 43.

In an exemplary embodiment, the signal generated by the controller 24 is based upon comparing the expected color stored in the memory 30 with a detected color of the wayside equipment 14, and the signal is configured to switch the locomotive 22 into one of a motoring mode and a braking mode. The motoring mode is an operating mode in which energy from a locomotive engine 50 or an energy storage device 51 (FIGS. 1-2) is utilized in propelling the locomotive 22 along the railroad 16, as appreciated by one of skill in the art. The braking mode is an operating mode in which energy from a locomotive engine 50 or locomotive braking system is stored in the energy storage device 51 (FIG. 2). Although the embodiments illustrated in FIGS. 1-2 involve the signal generated by the controller 24 being sent to the engine 50 to switch the locomotive 22 into the motoring mode or the braking mode, the controller 24 may transmit the signal to the engine 50 to reduce the power notch setting or limit the power notch setting of the engine 50, for example. In addition, the controller 24 may transmit the signal to the memory 30, to record each signal and thus the performance of the system 10, for subsequent analysis. For example, after the locomotive 22 has completed a trip, the controller 24 signals stored in the memory 30 may be analyzed to determine whether the system 10 was executed properly. In addition, the controller 24 may transmit the signal to other devices within the system 10 to generate different responses based on the processing of the visible spectral data. For example, the controller 24 may transmit the signal to an audible warning device 60, such as a horn, for example. As another example, the controller 24 may transmit the signal to a headlight of the locomotive 22. Thus, the controller 24 may transmit the signal to any device within the locomotive 22, to initiate an action based upon the processing of the visible spectral data from the wayside equipment 14, such as the light signal. In an exemplary embodiment, if the controller 24 determines that the color of the wayside equipment 14, such as the light signal does not correspond with the expected color of the wayside equipment 14, such as the light signal stored in the memory 30, the controller 24 may transmit a signal to the engine 50 to initiate the braking mode to slow down the locomotive 22 or transmit a signal to the audible warning device 60, to alert the operator of a possible dangerous condition, for example.

In the exemplary embodiment where the wayside equipment 14 is a light signal, the video cameras 18,19 are configured to process a plurality of frames of the light signal portion 27 to determine if the wayside equipment 14, such as the light signal, is in one of a flashing mode and non-flashing mode. For example, the video cameras 18,19 would generate a multiple set of images 12, as illustrated in FIG. 4, and determine whether or not the light signals are flashing or not. The flashing mode may be indicative of a particular upcoming condition along the railroad, such as a dangerous condition, for example. In the locomotive 22 cabin, a single operator may be used to operate the locomotive. As stated above, in an exemplary embodiment, in response to the controller 24 determining that the light signal or other wayside equipment 14 is in the flashing mode indicative of a dangerous condition, the controller may transmit the signal to the engine 50 to initiate the braking mode, the motoring mode, to modify or limit a power notch setting, or transmit the signal to the audible warning device 60, to alert the operator of a possible dangerous condition, for example.

Figure 6:
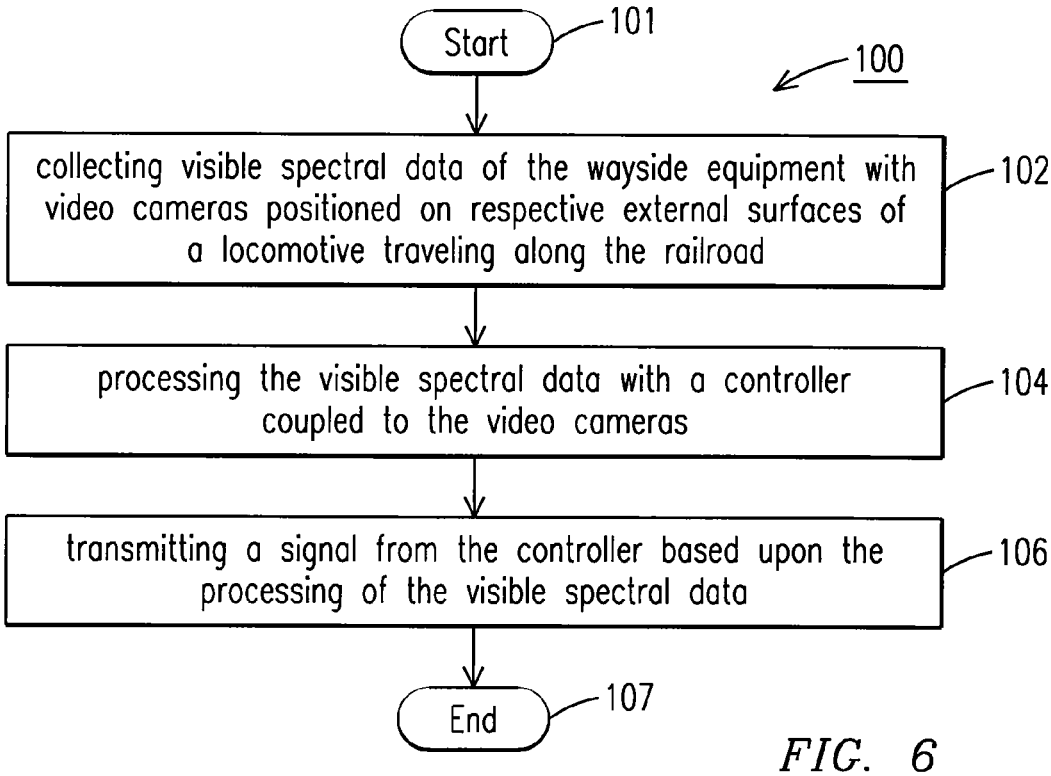
FIG. 6 is a flow chart illustrating an exemplary embodiment of a method for processing images of wayside equipment according to the present invention.

FIG. 6 illustrates an exemplary embodiment of a method 100 for processing images 12 of wayside equipment 14 adjacent to a railroad 16. The method 100 begins at 101 by collecting 102 visible spectral data of the wayside equipment 14 with video cameras 18,19 positioned on respective external surfaces 20,21 of a locomotive 22 traveling along the railroad 16. The method 100 further includes processing 104 the visible spectral data with a controller 24 coupled to the video cameras 18,19. The method 100 further includes transmitting 106 a signal from the controller 24 based upon processing of the visible spectral data, before ending at 107.

Figure 7:
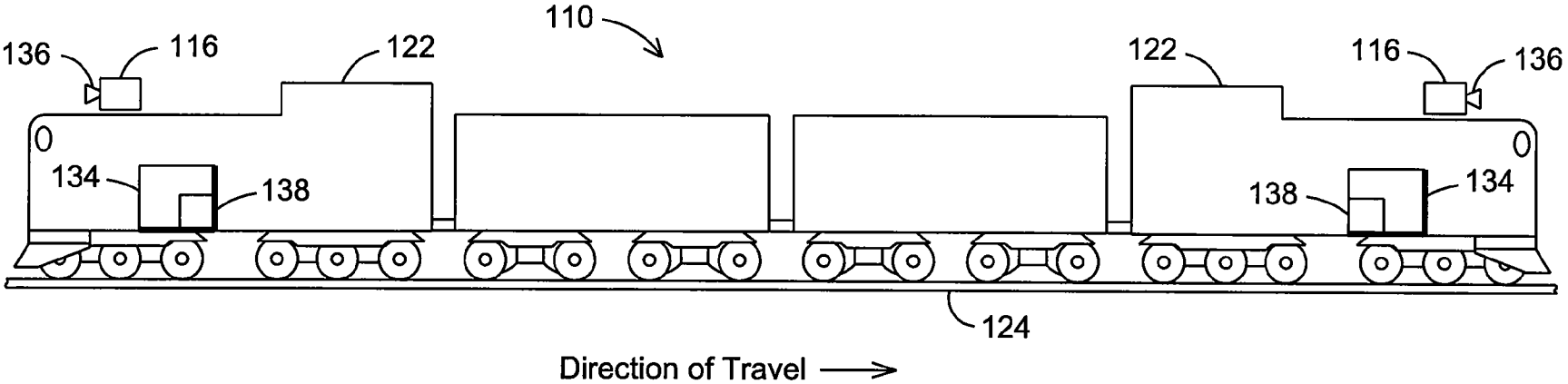
FIG. 7 is a side view of a locomotive within a system for determining an informational property of wayside equipment adjacent to a railroad, according to an exemplary embodiment of the present invention.
Figure 8:
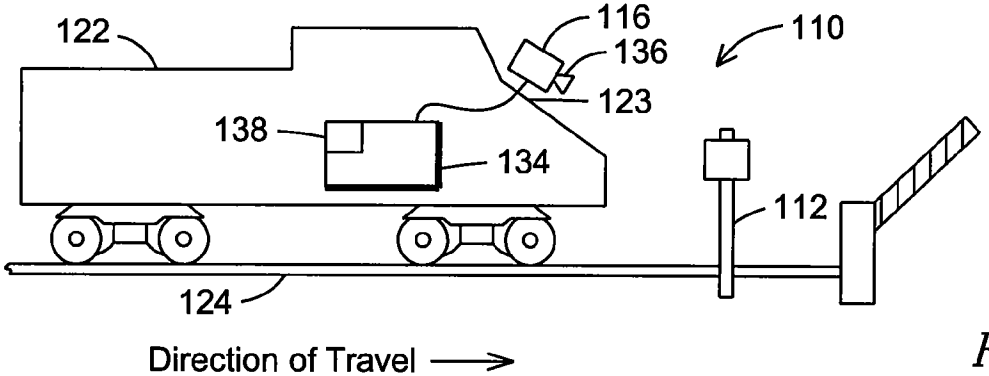
FIG. 8 is a side view of an exemplary embodiment of a locomotive within the system for determining an informational property of wayside equipment adjacent to a railroad illustrated in FIG. 7.
Figure 12:
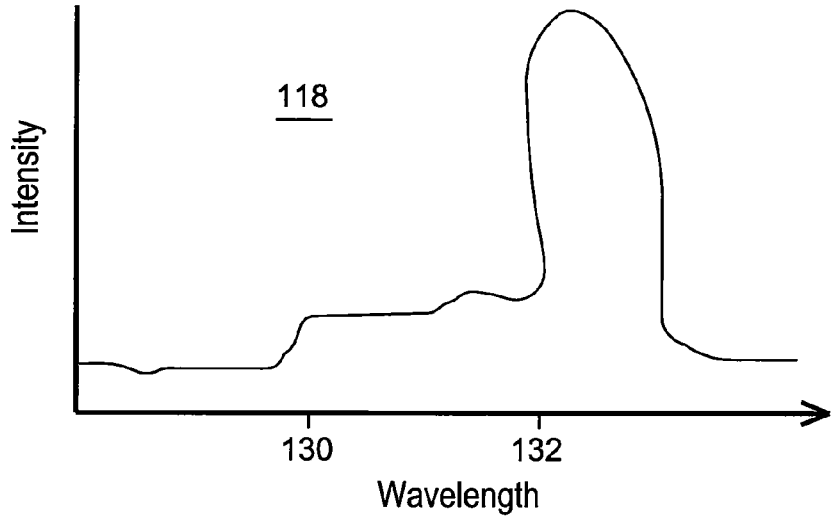
FIG. 12 is a plot of an exemplary embodiment of the intensity versus the spectral wavelength for the unfiltered spectral data illustrated in FIG. 10.
Figure 13:
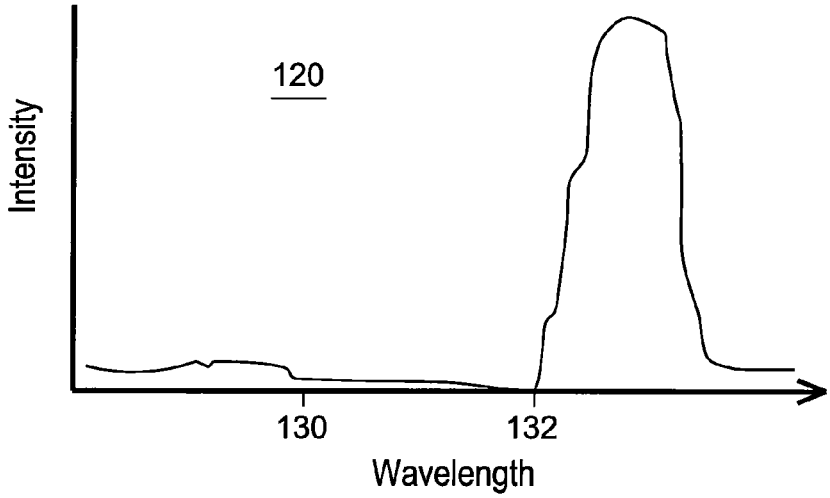
FIG. 13 is a plot of an exemplary embodiment of the intensity versus the spectral wavelength of filtered spectral data of FIG. 12 passed through one filter.

FIGS. 7-8 illustrate an exemplary embodiment of a system 110 for determining an informational property of wayside equipment 112 adjacent to a railroad 124. The system 110 includes a video camera 116 to collect visible spectral data 118,120,121 (FIGS. 12-14) of the wayside equipment 112. In the illustrated exemplary embodiment of FIG. 8, the video camera 116 is positioned on an external surface 123 of a locomotive 122 traveling along the railroad 124. As further illustrated in the exemplary embodiment of FIG. 8, the wayside equipment 112 is a light signal positioned adjacent to the railroad 124, and the system 110 may determine an informational property such as a color of the light signal, for example.

Figure 9:
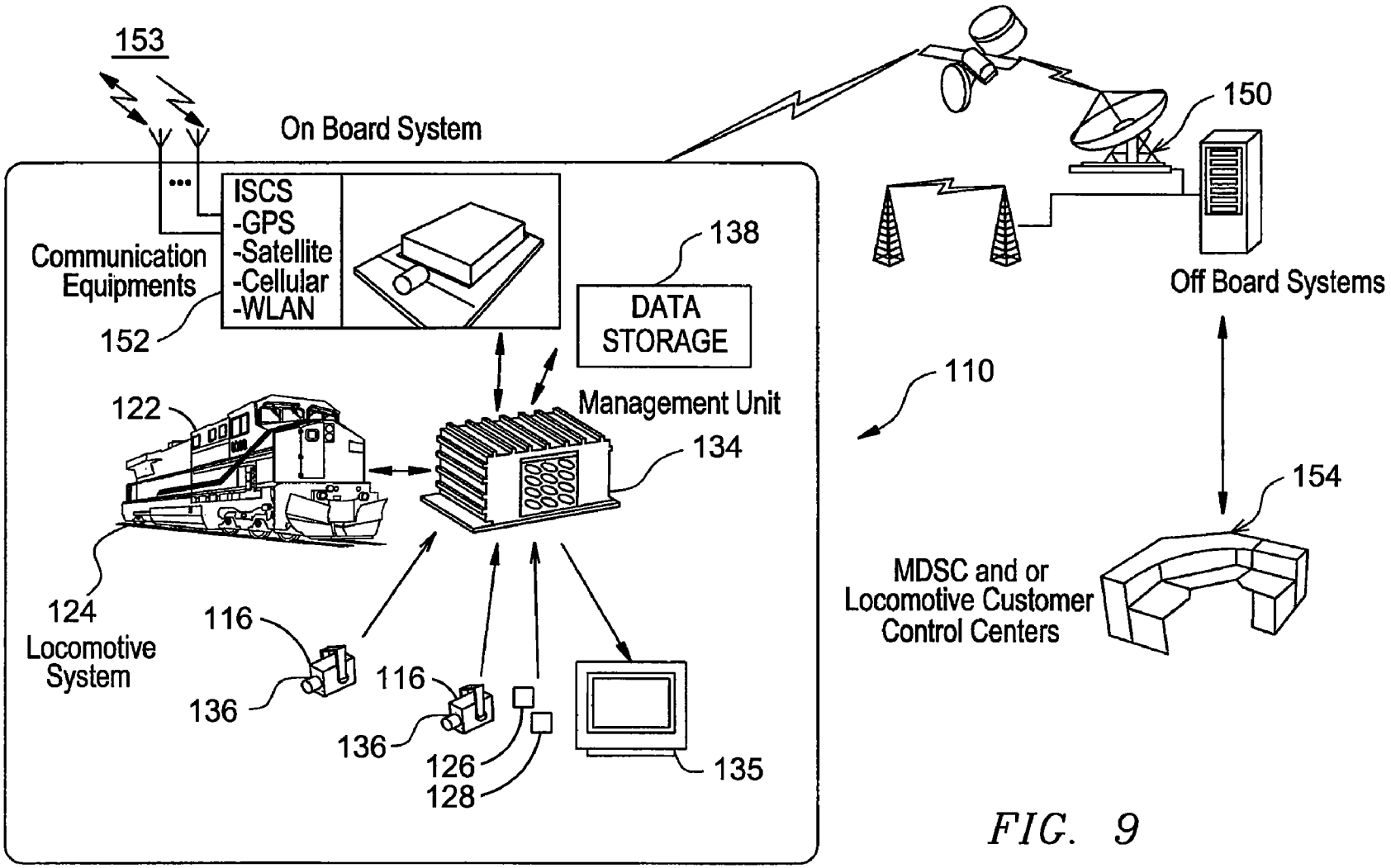
FIG. 9 is a schematic view of an exemplary embodiment of a system for determining an informational property of wayside equipment adjacent to a railroad according to the present invention.

As further illustrated in FIG. 9, the system 110 includes a plurality of filters 126,128, where the filters 126,128 are configured to filter a known portion 130,132 (FIGS. 12-14) of the visible spectral data 118,120,121 based upon known properties of the filters 126,128. Upon positioning one or more of the filters 126,128, the filter(s) is/are positioned between a lens 136 of the video camera 116 and the wayside equipment 112, in order to ensure that spectral data from the wayside equipment 112 passes through the filter(s) 126,128, prior to entering the video camera 116. In the exemplary embodiment of FIG. 9, the filters 126,128 may be color filters configured to filter a respective known portion 130,132 (FIGS. 12-14) of the visible spectrum, based upon known properties of the color filter.

Figure 10:
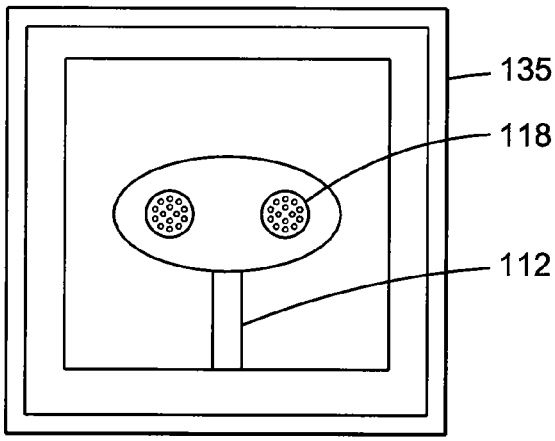
FIG. 10 is a front plan view of an exemplary embodiment of a monitor illustrating unfiltered spectral data from the wayside equipment illustrated in FIG. 8.

As further illustrated in the exemplary embodiment of FIGS. 8-9, a controller 134 is coupled to the video camera 116. The controller 134 is configured to compare unfiltered visible spectral data 118 (FIGS. 10,12), obtained prior to positioning the filters 126,128, with the filtered visible spectral data 120,121 (FIGS. 11, 13-14) obtained subsequent to positioning the filters 126,128. The controller 134 compares the unfiltered visible spectral data 118 and the filtered visible spectral data 120,121 in conjunction with the known properties of the filters 126,128 to determine the informational property of the wayside equipment 112, such as the color of a light signal, for example. The controller 134 may communicate this informational property of the wayside equipment 112 to an offboard system 150 using a wireless communication system 152 including one or more transceiver(s) 153, for example. The offboard system 150 may process the informational property of the wayside equipment 112, such as the colors of the light signals, and communicate this information to other locomotives in the vicinity of the locomotive 122, for example, or construct a real-time grid of the color indications of the light signals, for example, which would be accessible by all of the locomotive operators. Additionally, the offboard system 150 may share the informational properties of the wayside equipment 112 with a locomotive customer control center 154, which may ensure that the locomotive 122 abides by all safety precautions, for example.

The controller 134 is configured to store unfiltered visible spectral data 118 in a memory 138 prior to positioning the filters 126,128. Once the controller 134 compares the unfiltered visible spectral data 118 with the filtered spectral data 120,121, the controller 134 determines the color of the wayside equipment 112 light signal based upon a color of the unfiltered spectral data 118 being removed from the filtered spectral data 120,121. The color filters 126,128 are configured to filter a discrete respective known portion 130,132 of color within the visible spectral data based upon the known properties of the color filters 126,128. In the exemplary embodiment of FIGS. 10-14, the color filters 126,128 filter the discrete respective known portion 130,132 of green and red light within the visible spectral data, for example. However, the color filters may be configured to filter any discrete portion of the visible spectrum, and less than two or more than two color filters may be utilized in an exemplary embodiment of the system 110.

Figure 11:
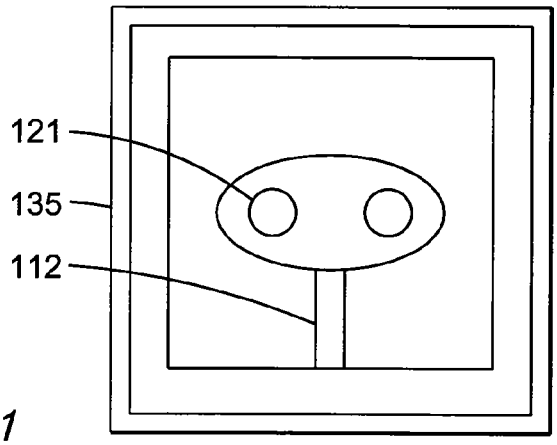
FIG. 11 is a front plan view of an exemplary embodiment of a monitor illustrating filtered spectral data from the wayside equipment illustrated in FIG. 8.
Figure 14:
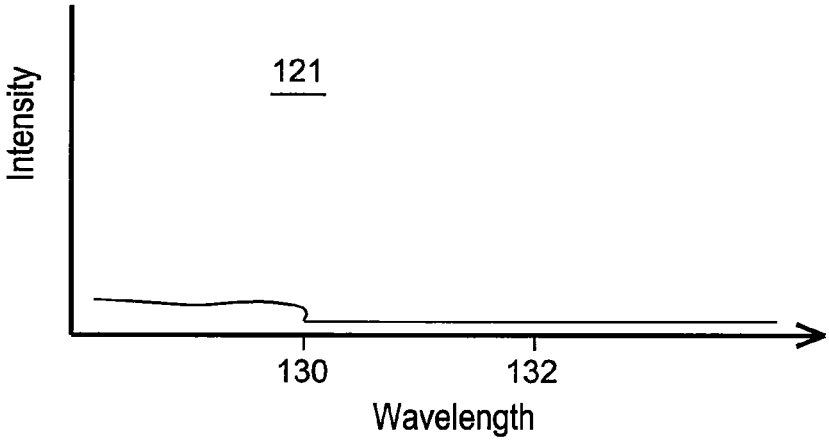
FIG. 14 is a plot of an exemplary embodiment of the intensity versus the spectral wavelength of filtered spectral data of FIG. 12 passed through two filters.

As illustrated in the exemplary embodiment of FIGS. 10-14, a display 135 illustrates an image of the wayside equipment 112 and the unfiltered spectral data 118 being emitted from the wayside equipment 112, such as a light signal, for example. The color filters 126,128 are individually consecutively positioned between the lens 136 and the wayside equipment 112 light signal until the filtered spectral data 121 has removed the color of the unfiltered spectral data 118 (FIG. 11). The controller 134 can determine the color of the wayside equipment 112 light signal and the unfiltered spectral data 118 by identifying the color of the filters 126,128 utilized to remove the color of the filtered spectral data 118. The controller 134 compares the unfiltered visible spectral data 118 with the filtered spectral data 120,121 for each respective individual filter 126,128. After the controller 134 recognizes the unfiltered spectral data 118 from the wayside equipment 112, without any color filters 126,128 positioned between the wayside equipment 112 and the lens 136 of the video camera 116, the controller 134 positions a color filter 126 between the wayside equipment 112 and the lens 136. The controller 134 may mechanically position a physical color filter, or electronically configure an electronic color filter to filter a discrete known portion 130 of the visible spectral data, for example. As discussed above, in the exemplary embodiment of FIGS. 10-14, the color filter 126 filters a discrete respective known portion 130 of green light within the visible spectral data. As a result, the filtered spectral data 120 (FIG. 13) subsequent to positioning the color filter 126 includes a noticeable decrease of intensity in the discrete known portion 130 of green light within the visible spectral data. The controller 134 compares the unfiltered spectral data 118 (FIG. 12) with the filtered spectral data 120 (FIG. 13), and determines if a common color or group of colors is present. In the exemplary embodiment, the controller 134 determines that the unfiltered spectral data 118 (FIG. 12) and filtered spectral data 120 (FIG. 13) include a common color of red, and thus the controller 134 positions a subsequent color filter 128 between the wayside equipment 112 and the lens 136 of the video camera 116. As discussed above, in the exemplary embodiment of FIGS. 10-14, the color filter 128 filters a discrete known portion 132 of red light within the visible spectral data. Upon positioning the color filter 128 between the wayside equipment 112 and the lens 136, the controller 134 compares the unfiltered spectral data 118 (FIG. 12) and the filtered spectral data 121 (FIG. 14). Since the unfiltered spectral data 118 and the filtered spectral data 121 do not include the common color of red found in the unfiltered spectral data 118, the controller 134 recognizes that the color of the unfiltered spectral data 118 coincides with the red color filter 128 which caused this red color to be removed in the filtered spectral data 121. Although the exemplary embodiment of FIGS. 10-14 discusses a red light signal as the wayside equipment 112, any color light signal may be utilized in conjunction with the system 110, and any type of color filters other than the green and red filters discussed above may be utilized.

Figure 15:
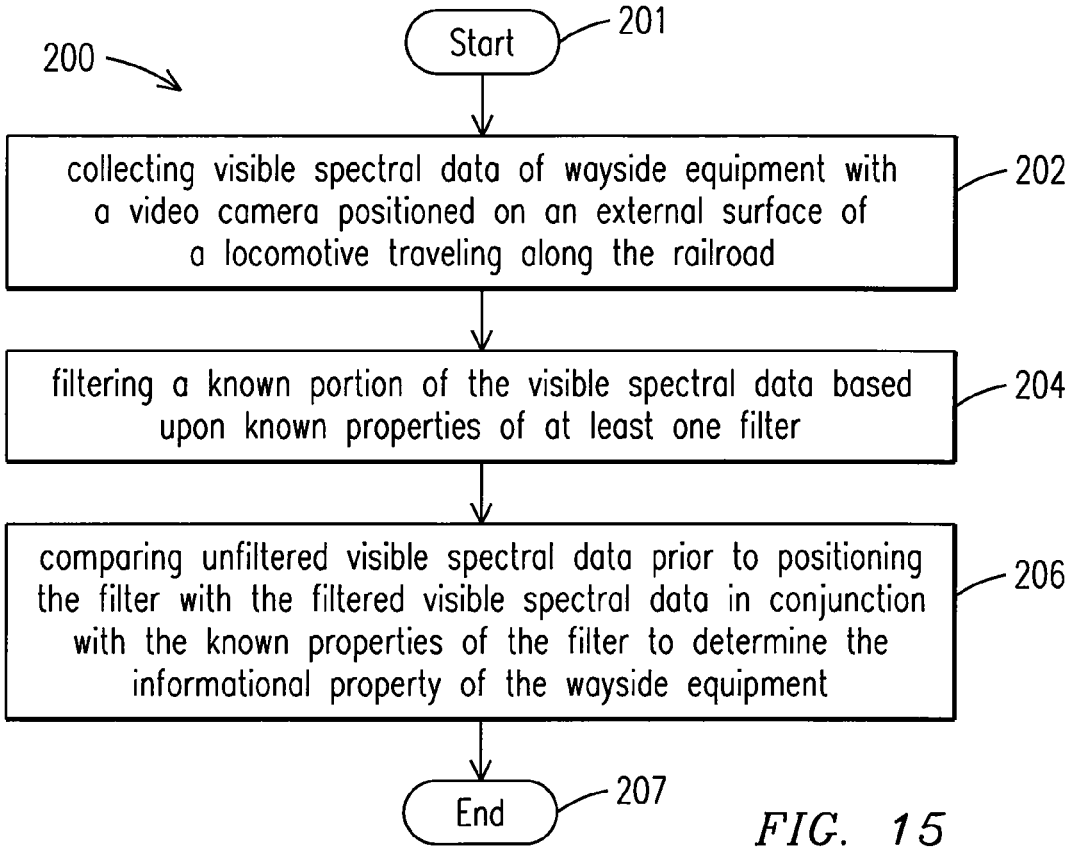
FIG. 15 is a flow chart illustrating an exemplary embodiment of a method for determining an informational property of wayside equipment adjacent to a railroad according to the present invention.

FIG. 15 illustrates an exemplary embodiment of a method 200 for determining an informational property of wayside equipment 112 adjacent to a railroad 124. The method 200 begins at 201 by collecting 202 visible spectral data 118 of the wayside equipment 112 with a video camera 116 positioned on an external surface 123 of a locomotive 122 traveling along the railroad 124. The method 200 further includes filtering 204 a known portion 130,132 of the visible spectral data 118 based upon known properties of at least one filter 126,128. (As should be appreciated, and as described above, "known property" refers to a characteristic or configuration of the filter for filtering visible spectral data, as known to the system. Thus, for example, if the known property of a filter is to filter red light in a particular range of wavelengths, then the filter will filter light in that manner.) The method 200 further includes comparing 206 unfiltered visible spectral data 118 prior to positioning the filter 126,128 with the filtered visible spectral data 120,121 in conjunction with the known properties of the filter 126,128 to determine the informational property of the wayside equipment 112, before ending at 207.

Although certain embodiments of the present invention have been described above with respect to video cameras, other image capture devices could be used instead if capable of capturing visible spectral data for filtering/processing in the manner described above. As such, unless otherwise stated herein, the term "camera" collectively refers to video cameras and other image capture devices for capturing visible spectral data.

Additionally, although certain embodiments of the present invention have been described above with respect to video cameras mounted on external surfaces of a vehicle, the invention contemplates and encompasses any cameras capable of capturing visible spectral data originating from sources external to the vehicle (e.g., wayside signal lights), and which typically are adjustable in terms of viewing angle for capturing spectral data from equipment located at expected positions.

Based on the foregoing specification, the above-discussed embodiments of the invention may be implemented using computer programming or engineering techniques including computer software, firmware, hardware or any combination or subset thereof, wherein the technical effect is to determine an informational property of wayside equipment adjacent to a railroad. Any such resulting program, having computer-readable code means, may be embodied or provided within one or more computer-readable media, thereby making a computer program product, i.e., an article of manufacture, according to the discussed embodiments of the invention. The computer readable media may be, for instance, a fixed (hard) drive, diskette, optical disk, magnetic tape, semiconductor memory such as read-only memory (ROM), etc., or any emitting/receiving medium such as the Internet or other communication network or link. The article of manufacture containing the computer code may be made and/or used by executing the code directly from one medium, by copying the code from one medium to another medium, or by transmitting the code over a network.

One skilled in the art of computer science will easily be able to combine the software created as described with appropriate general purpose or special purpose computer hardware, such as a microprocessor, to create a computer system or computer sub-system of the method embodiment of the invention. An apparatus for making, using or selling embodiments of the invention may be one or more processing systems including, but not limited to, a central processing unit (CPU), memory, storage devices, communication links and devices, servers, I/O devices, or any sub-components of one or more processing systems, including software, firmware, hardware or any combination or subset thereof, which embody those discussed embodiments the invention.

Figure 16:
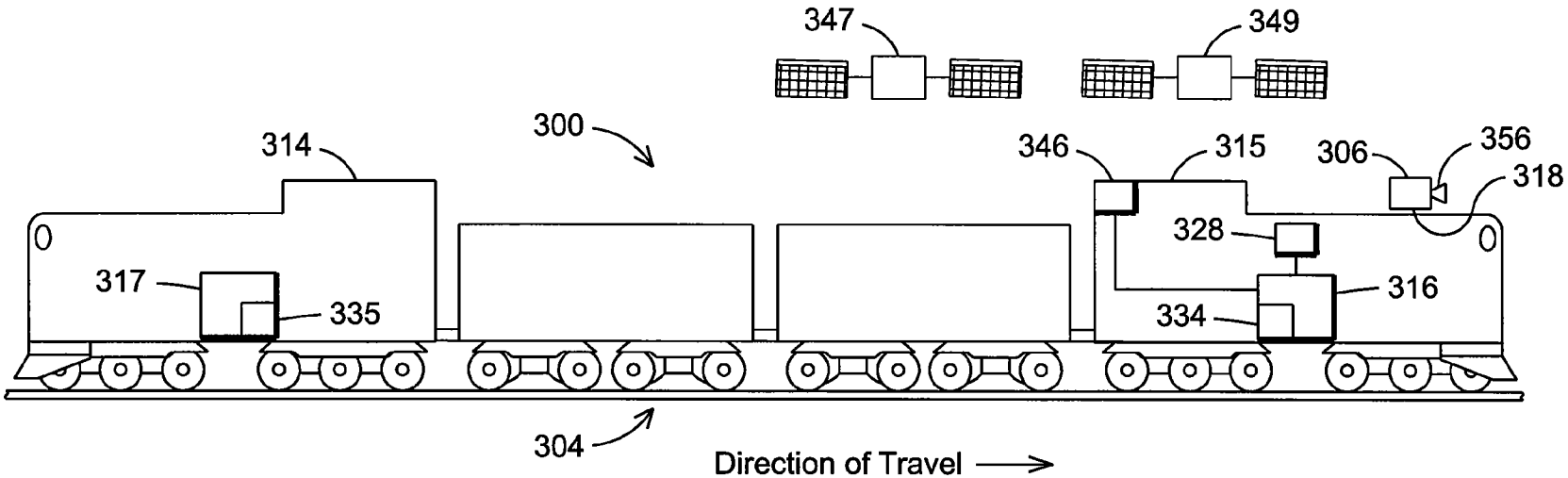
FIG. 16 is a side view of a locomotive within a system for determining characteristic information of an object positioned adjacent to a route, according to an exemplary embodiment of the present invention.

FIG. 16 illustrates an exemplary embodiment of a system 300 for determining characteristic information of an object, such as a railroad signal 302, for example, positioned adjacent to a route, such as a railroad 304, for example. The system 300 includes a thermal imaging camera 306 (FIG. 16) positioned on an external surface 318 of a powered system, such as a locomotive 315 traveling along the railroad 304. Additionally, the system 300 includes a video camera 308 (FIG. 17) positioned on an external surface 320 of the locomotive 315. (As should be appreciated, although one camera 306 is shown on the locomotive 315 in FIG. 16 and the other camera 308 on the locomotive 315 in FIG. 17, in implementation the two cameras 306,308 are positioned on the same locomotive.) The train 301 illustrated in FIG. 16 includes a pair of locomotives 314,315, which may face opposite directions, and a thermal imaging camera and video camera (not shown) may be similarly mounted on the locomotive 314 and utilized in a similar fashion as the cameras 306,308 discussed below. The locomotive 314 may have an independent controller 317 with a memory 335 to control the operation of these cameras, for example. Although FIG. 16 illustrates a train 301 including a pair of locomotives 314,315, the embodiments of the present invention are applicable to other powered systems which travel along a route, such as an off-highway vehicle, a marine vehicle, a transport bus, and/or an agricultural vehicle, for example.

Figure 17:
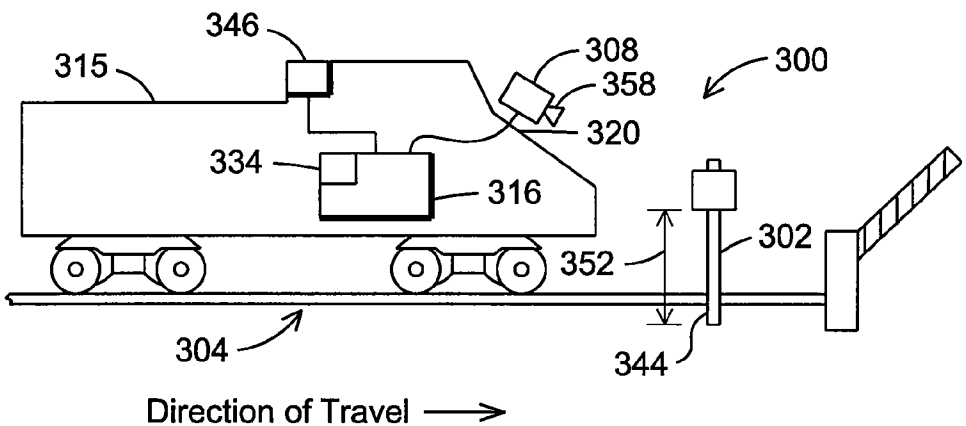
FIG. 17 is a side view of an exemplary embodiment of the locomotive within the system illustrated in FIG. 16.

The thermal camera 306 is configured to collect non-visible spectral data from the railroad signal 302, while the video camera 308 is configured to collect visible spectral data from the railroad signal 302. The system 300 further includes a controller 316 coupled to the thermal camera 306 (FIG. 16) and the video camera 308 (FIG. 17). The controller 316 is configured to determine the characteristic information of the railroad signal 302, based on the collected non-visible spectral data and/or visible spectral data. Such characteristic information of the railroad signal 302 may include an active status of the railroad signal 302 and/or a color of the railroad signal 302, in addition to other optical characteristic properties of the railroad signal, for example. The controller 316 is configured to determine the active status of the railroad signal 302 and/or the color of the railroad signal 302, to acquire information used in the operation of the locomotive 315 along the railroad 304, such as an upcoming condition along the railroad 304 and/or a topographic characteristic along the railroad 304, for example.

Figure 18:
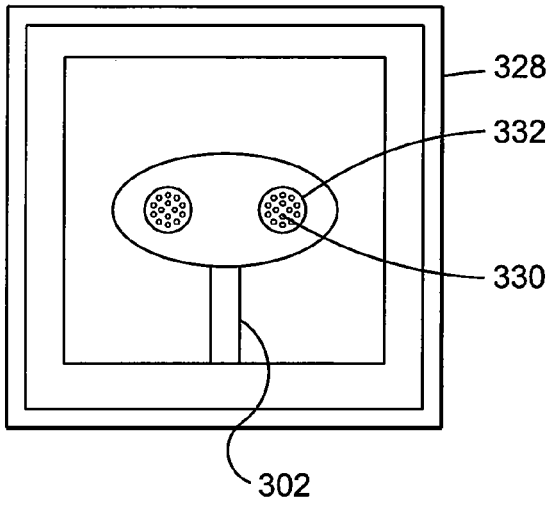
FIG. 18 is a front plan view of an exemplary embodiment of a display illustrating a thermal image and a video image, based on spectral data obtained from the object illustrated in FIG. 16.

The non-visible spectral data collected by the thermal camera 306 may be infrared spectral data, for example, which provides data indicative of the temperature signature of the railroad signal 302. As illustrated in FIG. 16, the controller 316 is coupled to a display 328 and is configured to output a thermal image 330 (FIG. 18) of the railroad signal 302, based upon the received infrared spectral data from the thermal camera 306. Additionally, the controller 316 may communicate with the display 328 to output a video image 332 (FIG. 18) of the railroad signal 302, based upon the received visible spectral data from the video camera 308. As illustrated in FIG. 18, the controller 316 is configured to simultaneously output the thermal image 330 and the video image 332, which tend to substantially overlap for the same railroad signal 302 source, and proximately positioned cameras 306,308 at the external surfaces 318,320. The controller 316 is configured to determine the active status and/or the color of the railroad signal 302, based on the thermal image 330 and/or the video image 332 of the railroad signal 302.

The memory 334 of the controller 316 may store the external surface 318,320 positions of the cameras 306,308, and thus the controller 316 may factor the stored external surfaces 318,320 in determining the degree to which the thermal image 330 overlaps with the video image 332, for example. The controller 316 may determine the degree to which the thermal image 330 overlaps with the video image 332, to ensure that both images 330,332 arise from the same railroad signal 302 source. The controller 316 may factor a greater separation of the external surfaces 318,320 as providing greater latitude in the overlap of the thermal image 330 and the video image 332, and vice versa, as discussed below.

In order for the controller 316 to determine the active status (e.g., whether the railroad signal 302 is on or off), the memory 334 of the controller 316 stores a minimum active temperature exhibited by the railroad signal 302 when it is active. (Minimum active temperatures can be determined in advance by testing signals and storing data relating to the temperatures in memory.) The controller 316 is configured to determine the active status of the railroad signal 302, based on whether the thermal image 330 of the railroad signal 302 indicates a railroad signal 302 temperature greater than the minimum active temperature. Additionally, the controller 316 may be configured to determine the active status of the railroad signal 302, based on whether the video image 332 of the railroad signal 302 has an overlap ratio with the thermal image 330 of the railroad signal 302 that exceeds a predetermined overlap ratio stored in the memory 334. Thus, for example, if the controller 316 determined that: (1) the railroad signal 302 temperature from the thermal image 330 varies between 200-230° F., and the minimum active temperature is 190° F., and (2) the video image 332 overlaps with 86% of the thermal image 330, and the predetermined overlap ratio is 80%, then the controller 316 may determine that the railroad signal 302 is active. However, if the controller 316 determined that: (1) the railroad signal 302 temperature from the thermal image 330 varies between 200-230° F., and the minimum active temperature is 190° F., and (2) the video image 332 overlaps with 50% of the thermal image 330, and the predetermined overlap ratio is 80%, then the controller 316 may determine that the railroad signal 302 is not active, as the low overlap ratio reveals that the thermal image 330 and the video image 332 may not be from the same railroad signal 302 source, for example. In yet another example, if the controller 316 determined that: (1) the railroad signal 302 temperature from the thermal image 330 varies between 50-80° F., and the minimum active temperature is 190° F., and (2) the video image 332 overlaps with 86% of the thermal image 330, and the predetermined overlap ratio is 80%, then the controller 316 may determine that the railroad signal 302 is not active, as the railroad signal 302 has not seemingly acquired the minimum required temperature of activation.

In order for the controller 316 to determine the color of the railroad signal 302, the memory 334 stores a predetermined visible spectrum for known colors that the railroad signal 302 may acquire. The controller 316 is configured to determine the color of the railroad signal 302 as an identified color among these known colors, based on: (1) comparing the visible spectral data of the railroad signal 302 with each of the predetermined visible spectrum of the known colors; (2) determining that the visible spectral data of the railroad signal 302 falls within a predetermined range of the predetermined visible spectrum of the identified color of the known colors; and (3) determining that the video image 332 of the railroad signal 302 has an overlap ratio with the thermal image 330 of the railroad signal 302 which exceeds the predetermined overlap ratio stored in the memory 334. Thus, for example, if the controller 316 determined that: (1) the visible spectral data of the railroad signal 302 falls within the predetermined range of the predetermined visible spectrum of red; and (2) the video image 332 overlaps with 86% of the thermal image 330, and the predetermined overlap ratio is 80%, then the controller 316 may determine that the railroad signal 302 is red. In another example, if the controller 316 determined that: (1) the visible spectral data of the railroad signal 302 falls within the predetermined range of the predetermined visible spectrum of red; and (2) the video image 332 overlaps with 70% of the thermal image 330, and the predetermined overlap ratio is 80%, then the controller 316 may determine that the railroad signal 302 is not red or unknown. This last example may be caused by a color coating painted on an outside of the railroad signal 302, but the railroad signal 302 may be in an inactive mode, for example. In an exemplary embodiment, the controller 316 may determine whether the: (1) railroad signal 302 temperature from the thermal image 330 exceeds the minimum active temperature, (2) the visible spectral data falls within the predetermined range of the predetermined visible spectrum of a known color of the railroad signal 302, and/or (3) the video image 332 overlaps within the thermal image 330 by at least the predetermined overlap ratio. Thus, in the above-discussed example of the color coating on the railroad signal 302 in an inactive status, the controller 316 would determine that the railroad signal 302 temperature does not exceed the minimum active temperature, and conclude that the railroad signal 302 is in an inactive status, for example. In this exemplary embodiment, the controller 316 may differentiate between: (1) an active status of a railroad signal 302 based on the railroad signal 302 temperature exceeding the minimum active temperature and, (2) an inactive status of the railroad signal 302 having the color-coating, based on the railroad signal temperature being lower than the minimum active temperature, despite that the active and inactive status railroad signals may output a similar visible spectrum.

Although the embodiments discussed above involve an initial determination as to whether the railroad signal 302 is in an active status, followed by a determination as to color of the railroad signal 302, the system 300 need not perform these steps in this particular order. For example, the controller 316 may initially determine the color of the railroad signal 302, followed by assessing the thermal image 330, to confirm that the railroad signal 302 is in an active status. Additionally, the controller 316 may consider a contrast factor when determining the color of the railroad signal 302 and whether the subsequent collection of non-visible data is needed, where the contrast factor is based on the time of day at the time of collecting the visible spectral data, and may be higher at night and lower during the day, for example. For example, if the video camera 308 collects visible spectral data at night time, and the controller 316 is capable of determining that the railroad signal 302 is red, the controller 316 may determine that the contrast ratio is sufficiently high that non-visible data does not need to be collected to verify the active status of the railroad signal 302, for example. Similarly, for example, if the video camera 308 collects visible spectral data during the day time, even if the controller 316 determines that the railroad signal 302 is red, the controller 316 may determine that the contrast ratio is not sufficiently high and will need to collect the non-visible spectral data to verify the active status of the railroad signal 302, for example.

Figure 19:
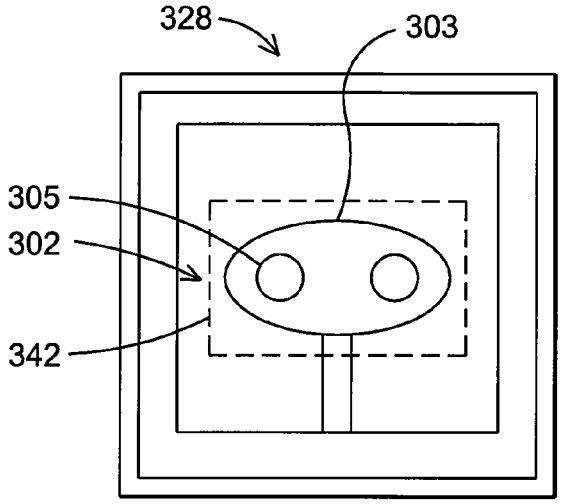
FIG. 19 is a front plan view of an exemplary embodiment of a display illustrating a thermal image and a video image, based on spectral data obtained from the object illustrated in FIG. 16.

As illustrated in FIG. 19, the thermal camera 306 and video camera 308 are configured to process pixels within an adjustable field of view 342, such that the thermal image 330 and the video image 332 within the adjustable field of view 342 is visible on the display 328. The field of view 342 is adjusted to coincide with a top portion 303 of the railroad signal 302, including lights 305 from which the non-visible spectral data and visible spectral data is collected to form the thermal image 330 and video image 332, respectively. Although FIG. 19 illustrates that the railroad signal 302 includes the lights 305 positioned at a top portion 303 of the railroad signal 302, the lights on the railroad signal may be positioned at any location along the railroad signal, and the exemplary railroad signal is merely one example. Preferably, the adjustable field of view 342 of the thermal camera 306 is adjusted to coincide with that of the video camera 308, such that the overlap ratio of the thermal image 330 and the video image 332 of a railroad signal 302 may be properly evaluated. For example, if the adjustable field of the view of the thermal camera 306 varied greatly from that of the video camera 308 such that the thermal image 330 indicated one light 305 while the video image 332 indicated two lights 305, an erroneous conclusion may result that one light is in an inactive status. In an exemplary embodiment, the controller 316 may be configured to adjust the field of view 342 of the thermal camera 306 and the video camera 308, such as by varying an adjustment parameter of a respective lens 356,358 (FIGS. 16-17) of the thermal camera 306 and video camera 308, for example.

The memory 334 of the controller 316 is configured to store an expected position 344 (FIG. 17) of the object along the route. As further illustrated in FIG. 16, the system 300 includes a position determination device 346, such as a global positioning system (GPS) receiver in communication with a pair of GPS satellites 347,349, for example, to determine a position of the locomotive 315 along the railroad 304. As the locomotive 315 travels past an incremental location along the railroad 304, the controller 316 is configured to compare the position of the locomotive 315 (from the position determination device 346) with the expected position 344 (from the memory 334). Once the position of the locomotive 315 reaches the expected position 344, the controller 316 is configured to transmit a signal to the thermal camera 306 to collect the non-visible spectral data of the railroad signal 302 positioned at the expected position 344. Similarly, once the position of the locomotive 315 reaches the expected position 344, the controller 316 is configured to transmit a signal to the video camera 308 to collect the visible spectral data of the railroad signal 302 positioned at the expected position 344. The respective field of view 342 of the thermal and video cameras 306,308 is adjusted to collect the respective non-visible and visible spectral data of the railroad signal 302 positioned at the expected position 344. As discussed above, in an exemplary embodiment, the controller 316 may adjust the respective field of view 342 of the thermal and video cameras 306,308 to simultaneously coincide with the top portion 303 of the railroad signal 302, and further to simultaneously coincide with the lights 305 positioned on the top portion 303 of the railroad signal 302.

Figure 20:
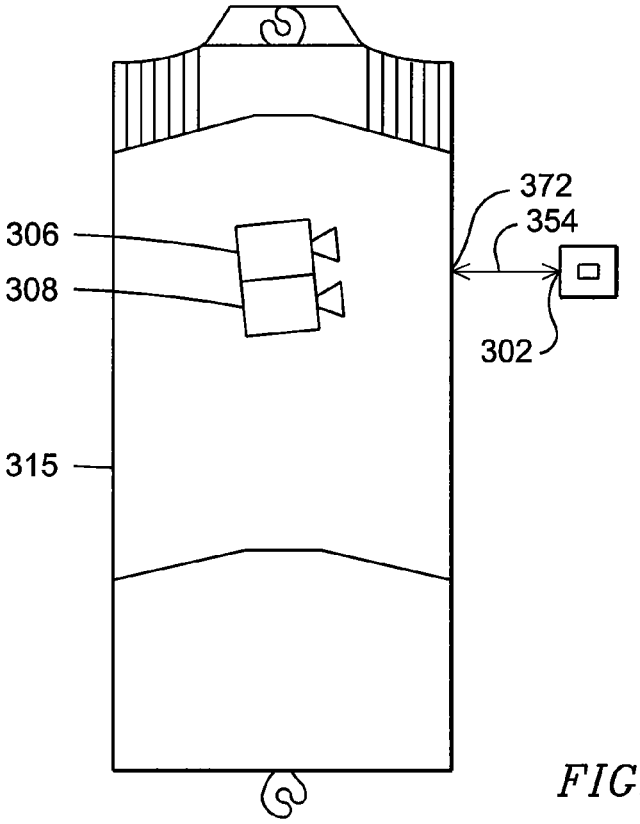
FIG. 20 is a top view of an exemplary embodiment of the locomotive within the system for determining characteristic information of the object positioned adjacent to the route illustrated in FIG. 16.

In an exemplary embodiment, the memory 334 is configured to further store one or more position parameter(s) 352, 354 of the railroad signal 302 at each expected position 344. The field of view 342 may be adjusted, as previously discussed, based upon the position parameter(s), to collect the non-visible and visible spectral data of the railroad signal 302 at the expected position 344. In an exemplary embodiment, the position parameter may be a perpendicular distance 352 (FIG. 17) from a ground portion to the railroad signal 302 and a perpendicular distance 354 (FIG. 20) from a portion of the railroad 304 to the ground portion.

Figure 21:
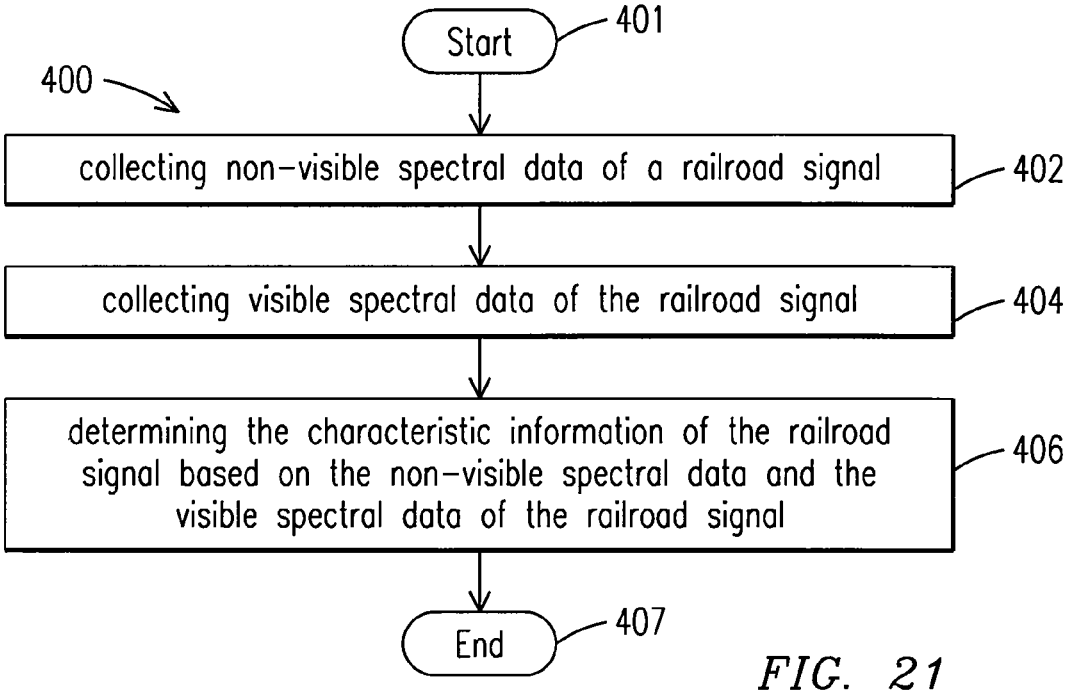
FIG. 21 is a flow chart illustrating an exemplary embodiment of a method for determining characteristic information of an object positioned adjacent to a route according to the present invention.

FIG. 21 illustrates a flowchart depicting an exemplary embodiment of a method 400 for determining characteristic information of a railroad signal 302 positioned adjacent to a railroad 304. The method 400 includes collecting 402 non-visible spectral data of the railroad signal 302. Additionally, the method 400 further includes collecting 404 visible spectral data of the railroad signal 302. The method 400 further includes determining 406 the characteristic information of the railroad signal 302 based on the non-visible spectral data and the visible spectral data of the railroad signal 302, before ending at 407.

Although the method 400 depicted in FIG. 21 involves collecting 402 non-visible spectral data, followed by collecting 404 visible spectral data, which are then subsequently processed in determining 406 the characteristic information of the railroad signal 302, the method may involve slight variations in the order of these steps. For example, the non-visible spectral data may be initially collected, and subsequently analyzed to determine whether or not the railroad signal is in an active status, prior to collecting and analyzing the visible spectral data. For example, if it is determined that the railroad signal is in an active status, the visible spectral data may then be subsequently collected and analyzed, as previously discussed. This slight re-arrangement of the method may advantageously involve minimal processing power and data collection, particularly where the railroad signal is determined to be in an inactive status, after which no visible spectral data is collected or analyzed, for example. As with the embodiments of the system 300 discussed above, the collecting 402,404 steps are initiated when the locomotive 315 reaches the expected position 344 (stored in the memory 334), and the controller 316 transmits a respective signal to the thermal camera 306 and the video camera 308. Although certain embodiments of the present invention have been described above with respect to video cameras, other image capture devices could be used instead if capable of capturing visible spectral data for identifying color in the manner described above. Additionally, although certain embodiments of the present invention have been described above with respect to thermal cameras, other image capture devices could be used instead if capable of capturing non-visible spectral data to identify the imaging source temperature in the manner described above. As such, unless otherwise stated herein, the term "video camera" collectively refers to image capture devices for capturing visible spectral data, while the term "thermal camera" collectively refers to image capture devices for capturing non-visible spectral data which is indicative of the thermal signature of the imaging source.

Additionally, although certain embodiments of the present invention have been described above with respect to video cameras and thermal cameras mounted on external surfaces of a vehicle, the invention contemplates and encompasses any such cameras capable of capturing visible or non-visible spectral data originating from sources external to the vehicle (e.g., wayside signal lights), and which typically are adjustable in terms of viewing angle for capturing spectral data from equipment located at expected positions.

Processing of infrared or other temperature or spectral data may take into consideration weather conditions external to the powered system, such as rain, snow, or other precipitation, and outside temperature.

In a general sense, the spectral data captured by each camera will fall within a particular spectral bandwidth, that is, a particular frequency bandwidth within the electromagnetic (EM) spectrum. For example, visible spectral data will typically relate to light radiation having a wavelength between approximately 400 nm and 700 nm, and non-visible spectral data will typically relate to EM radiation having a wavelength below 400 nm or above 700 nm. For example, infrared spectral data will typically relate to EM radiation having a wavelength of approximately greater than 700 nm (more typically greater than 750 nm) and up to 1 mm. In one embodiment, the frequency/spectral bandwidth of the spectral data captured by one camera will be different from the frequency/spectral bandwidth of the spectral data captured by the other camera, meaning that at least one of the cameras captures spectral data from a frequency bandwidth not captured by the other. In another embodiment, the frequency bandwidths of the spectral data captured by the two cameras do not overlap at all.

This written description uses examples to disclose embodiments of the invention, including the best mode, and also to enable any person skilled in the art to make and use the embodiments of the invention. The patentable scope of the embodiments of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

That which is claimed is:

1. A system for determining one of an active status and a color of a light signal positioned adjacent to a route, said system comprising:

a thermal camera configured to collect infrared spectral data of said light signal, said first camera being attached to an exterior surface of a powered system traveling along said route;

a video camera configured to collect visible spectral data of said light signal, said video camera being attached to the exterior surface of the powered system; and a controller coupled to said thermal camera and said video camera, said controller being configured to determine said one of the active status and color of the light signal based on said infrared spectral data and said visible spectral data of said light signal;

wherein said controller includes a memory to store a minimum active temperature required to activate the light signal, and wherein said controller is configured to determine said active status of said light signal, based upon;

said infrared spectral data including a light signal temperature greater than the minimum active temperature, and said visible spectral data having an overlap ratio with said infrared spectral data which exceeds a predetermined overlap ratio stored in the memory.

2. The system of claim 1, wherein said powered system is one of an off-highway vehicle, a marine vehicle, a rail vehicle, a transport bus, and an agricultural vehicle.

3. The system of claim 1, wherein said controller includes a memory to store a predetermined visible spectrum for a respective plurality of colors of the light signal; and said controller is further configured to determine said color of said light signal as an identified color among said plurality of colors, based upon:

said visible spectral data of said light signal being compared with the predetermined visible spectrum of the plurality of colors;

said visible spectral data of said light signal being within a predetermined range of the predetermined visible spectrum of the identified color among said plurality of colors.

4. The system of claim 1, wherein said controller is configured to determine an inactive light signal status based upon said infrared spectral data of said light signal indicating a light signal temperature lower than the minimum active temperature.

5. The system of claim 1, wherein said controller is configured to determine an inactive light signal status based upon said infrared spectral data of said light signal having overlapped with said visible spectral data of said light signal by less than the predetermined overlap ratio.

6. The system of claim 1, wherein said light signal is a colored light signal having a colored coating covering over at least a portion of said colored light signal, said controller is configured to distinguish between:

an active status of the light signal based upon said light signal temperature exceeding said minimum active temperature; and an inactive status of the light signal based upon said light signal temperature being lower than said minimum active temperature.

7. The system of claim 1, wherein said thermal and video cameras are configured to process pixels within an adjustable field of view, said adjustable field of view being adjusted to coincide with said light signal; and wherein said controller includes a memory configured to store at least one expected position of said light signal along said route.

8. The system of claim 7, further comprising:

a position determination device to determine a position of said powered system along said route; wherein:

at one of a plurality of incremental locations along the route, said controller is configured to compare the position of the powered system with said expected position;

upon said position of the powered system having reached said expected position, said controller is configured to transmit a signal to said thermal camera to collect said infrared spectral data of said light signal positioned at said expected position;

said controller is further configured to transmit a signal to said video camera to collect said visible spectral data of said light signal positioned at said expected position; and the respective field of view of said thermal and video cameras is adjusted to collect said respective infrared and visible set of spectral data of said light signal positioned at said expected position.

9. The system of claim 7, wherein said memory is configured to further store at least one position parameter of said light signal at each expected position; and said field of view is adjusted based upon said at least one position parameter stored in the memory to collect said infrared and visible set of spectral data of said light signal positioned at said expected position.

10. The system of claim 9, wherein said at least one position parameter comprises at least one of a perpendicular distance from a ground portion to said light signal and a distance from a portion of said route to said ground portion.

11. The system of claim 1, wherein said thermal imaging camera and said video camera are configured to determine said active status of said light signal and/or the color of said light signal as indicative of at least one of an upcoming condition along the route, or at least one topographic characteristic along the route.

12. A method for determining one of an active status and a color of a light signal positioned adjacent to a route, said method comprising:

collecting a infrared set of spectral data of said light signal;

collecting a visible set of spectral data of said light signal; and determining said one of the active status and the color of said light signal based on said infrared set of spectral data and said visible set of spectral data of said light signal;

storing a minimum active temperature required to activate the light signal;

determining said active status of said light signal, based on the steps of;

determining if a light signal temperature of said infrared set of spectral data exceeds the minimum active temperature, and determining if an overlap ratio of said visible data of said light signal with said infrared spectral data of said light signal exceeds a predetermined overlap ratio stored in the memory.

13. The method of claim 12, further comprising:

storing a predetermined visible spectrum for a respective plurality of colors of the light signal;

determining said color of said light signal as an identified color among said plurality of colors, based upon the steps of;

comparing said visible spectral data of said light signal with the predetermined visible spectrum of the plurality of colors, determining whether said visible spectral data of said light signal is within a predetermined range of the predetermined visible spectrum of the identified color among said plurality of colors, and determining if an overlap ratio of said visible spectral data of said light signal with said infrared spectral data of said light signal exceeds a predetermined overlap ratio stored in the memory.

* * * * *